United States Patent [19]

Graves

[11] Patent Number: 4,904,193

[45] Date of Patent: Feb. 27, 1990

[54] ELECTRICAL GROUNDING CLAMP

[75] Inventor: Thomas F. Graves, Fort Worth, Tex.

[73] Assignee: Southwestern Bell Telephone Company, St. Louis, Mo.

[21] Appl. No.: 183,902

[22] Filed: Apr. 20, 1988

[51] Int. Cl.[4] ..... H01R 4/66

[52] U.S. Cl. ..... 439/92; 439/803; 439/814

[58] Field of Search ..... 174/556, 6; 269/147, 269/149; 439/42, 95, 100, 430–435, 801, 803, 811–814

[56] References Cited

U.S. PATENT DOCUMENTS

| | | | |
|---|---|---|---|
| 1,486,560 | 3/1924 | Becker | 439/100 |
| 1,986,028 | 1/1935 | Terry | 439/100 |
| 2,260,136 | 10/1941 | Bergen . | |
| 2,301,786 | 11/1942 | Millermaster . | |
| 2,547,932 | 4/1951 | Downs | 439/100 |
| 2,632,068 | 3/1953 | Froebel | 439/803 X |
| 2,710,381 | 6/1955 | Monson . | |
| 3,021,581 | 2/1962 | Cook et al. . | |
| 3,166,632 | 1/1965 | Woodman . | |
| 3,562,694 | 2/1971 | Howe | 439/803 X |
| 3,680,031 | 7/1972 | Schumacher . | |
| 3,914,001 | 10/1975 | Nelson et al. | 439/92 |
| 4,778,413 | 10/1988 | Saarinen | 439/803 |
| 4,784,621 | 11/1988 | Auclair | 439/811 X |

OTHER PUBLICATIONS

Drawing, completed about Apr., 1987, displaying meter box clamp of Senior Industries, Inc. of Wood Dale, Ill.

Advertisement of Senior Industries, Inc. of Wood Dale, Ill. of meter box ground clamp which it offers for sale.

*Primary Examiner*—Eugene F. Desmond

*Attorney, Agent, or Firm*—Sandler & Greenblum

[57] ABSTRACT

A removable electrical ground clamp is provided that is easily installed on an outside electrical meter or breaker box by establishing pressure contact with the box. An attachment lug is provided on the grounding clamp for connecting a ground wire for use when electrical power is to be brought to a residence or some other outside electrical work or installation. The grounding clamp is designed to eliminate the need for access into an area of a residence or other building to establish a ground connection, provides instant visual inspection; and two grasping arms can be moved along an elongated member, which can be cylindrical, hexagonal, or U-shaped, in order to securely grip the outer surface of the meter or breaker box.

32 Claims, 5 Drawing Sheets

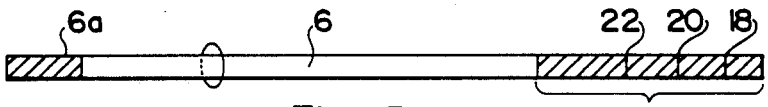
Fig. 5
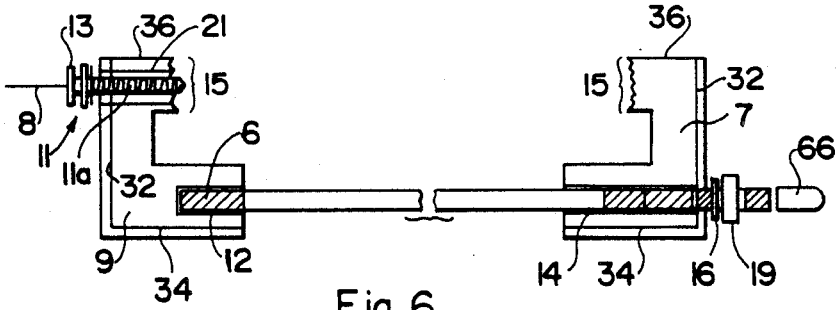
Fig. 6
Fig. 7
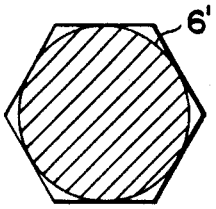
Fig. 8
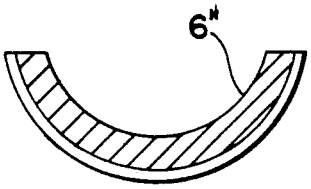

ELECTRICAL GROUNDING CLAMP

BACKGROUND OF THE INVENTION

1. Technical Field of the Invention

The present invention generally relates to a clamp used in the grounding of electrical systems, and more specifically to a grounding clamp that can be easily attached to an existing and readily accessible electrical ground surface of a fixture to provide an adequate ground connection.

2. Discussion of Relevant Information

Currently, for installations involving electrical service where power is brought to a residence, for example, technicians must provide on-premise grounding, which is most commonly established either via an attic ground connection or on an exterior cold water pipe. These types of installations, used to establish an adequate ground connection, generally involve the use of #10 or #12 ground wire run from a ground terminal on the electrical equipment to, e.g., the nearest external cold water pipe, or to a ground connection within the residence, where the wire is then terminated by attaching a standard grounding clamp to such a connection. Implementation of either of these options for making such a grounding connection have obvious drawbacks.

With use of an attic ground, for example, a technician must have access to the interior of the premises in which he is operating, as well as access to an appropriate connection, which is frequently found in a residential attic. Finding a suitable ground connection in such circumstances is too uncertain to be reliable, in terms of both the time and effort involved. Further, attachment to an attic connection usually requires a customer to be home, even in situations where no other inside work has been requested. This often results in missed appointments and repeated, costly trips by technicians to the work area. Besides the accessibility problem, attic work is often dangerous, with the potential for property damage.

One other presently used option, i.e., of using the ground of an exterior cold water pipe, usually requires long and unsightly wire runs that can come loose due to inadequate connections, or which can be tripped over by the workman or by others passing through the area. The actual attachment of the wire to a cold water pipe also has an inherent uncertainty in that it is often impossible to establish a solid physical connection. In addition, many cold water systems now use P.V.C. pipes, either in their original construction or in subsequent repair and replacement, which are nonmetallic and which render the cold water pipe useless for a ground connection.

A further problem inherent with establishing an electrical ground connection inside a building, or at an external point via attachment to a cold water pipe, resides in the difficulty of visual inspection. Hence, decreased safety results due to the risk that an improperly grounded system will exist if a ground connection were faulty or were not established.

SUMMARY OF THE INVENTION

The ground clamp disclosed by this invention is designed to provide an easily installed, reliable ground connection for electrical work, as e.g., is typically provided at residential dwellings where electrical power must necessarily be brought to the premises. The ground clamp is connected to an electrical meter or breaker box, which is usually readily available and easily accessible, by means of mechanical pressure. No modification to the box will be required, and the attachment will be in compliance with all requirements under the National Electric Code. The use of the clamp thus provides substantial savings to users by minimizing installation time, while providing better service for customers by not requiring access to premises in trying to locate a suitable connection point within a dwelling or other building. In addition to electrical construction work applications, the clamp is also easily adaptable for use in cable television installations, or with any circuit or device wherein an electrical ground is needed. It can also be used as a support for the attachment of, e.g., various closures, brackets, or wiring.

Because the grounding clamp is located on a building exterior, there is no need for a technician to enter a residence, thereby eliminating costs associated with missed appointments and repeated trips back to the work area to obtain access for making an electrical ground connection. It also reduces costs by minimizing employee injuries and property damage which might occur as a result, for example, of attic work accidents within a residence. The clamp provides for instant visual inspection of the ground connection while eliminating potentially dangerous and unsightly ground wire runs on the exterior of a customer's premises. Thus, its use significantly reduces the cost of labor and materials, and its simple installation requires a minimum of employee training.

The clamp could be manufactured from any conductive metal or alloy that would meet strength requirements to insure adequate mechanical contact to an existing structure, such as to the outer metal box or frame of an electrical power meter.

In a first aspect, the present invention provides an electrical grounding clamp adapted to be removably attached to a ground fixture. The clamp comprises an elongated member comprising an electrically-conductive metal, which elongated member has a first end and a second end; a first grasping arm and a second grasping arm, with each of the arms comprising means for gripping an exterior surface of the ground fixture; means for attaching an external grounding wire to the first grasping arm; means for attaching the first grasping arm to the first end of the elongated member; means for mounting the second grasping arm to a second end of the elongated member; and spacing adjustment means, located at one of the ends of the elongated rod, for varying the spacing between the first grasping arm and the second grasping arm when the grasping arms are positioned on the first and second member ends.

The elongated member can comprise, e.g., a solid cylindrical rod having a substantially uniform outer diameter. At least the first rod end is threaded over a predetermined distance; alternatively, both of the rod ends are threaded over a predetermined distance. The member can also comprise either a hexagonally-shaped or U-shaped elongated rod.

The spacing adjustment means are rotatably positioned about one of the member/rod ends, and at least one of the ends is threaded such that the spacing adjustment means can comprise, e.g., a nut having internal machine threads which are adapted to engage one threaded rod end, i.e., the threaded second rod end. Each of the grasping arms is substantially L-shaped, with the gripping means on each of the arms including a serrated edge comprising means for establishing physical and mechanical contact with the exterior surface of the ground fixture when the clamp is attached to the fixture. Alternately, the gripping surface could be roughened, or diamond shaped, e.g., as long as it includes a plurality of points which can pierce the paint of the ground fixture.

The first grasping arm and the second grasping arm are both adapted to be placed into contact with opposite side of the ground fixture by the spacing adjustment means, wherein the spacing adjustment means thereby comprise means for reducing the spacing between the first grasping arm and the second grasping arm.

The nut is rotatably movable along the member/rod from the second rod end towards the first rod end, the nut comprising means for effecting pressure against the second grasping arm and for moving the second grasping arm inwardly towards the first rod end so as to reduce the spacing between the first grasping arm and the second grasping arm. The first grasping arm comprises an interior cavity of a predetermined length, the cavity having a threaded interior surface adapted to threadably engage the first rod end, which first rod end is also threaded.

The serrated edges of each of the grasping arms comprises a saw-tooth shaped surface area comprising a plurality of fixture engaging peaks, with the peaks being spaced apart from each other by a predetermined, uniform distance; or a plurality of diamond-shaped tips.

The second grasping arm comprises a cylindrical through-bore extending longitudinally through the second grasping arm. The second rod end is positioned within the through-bore, and the second rod end extends beyond the second clamp, wherein a nut and a lock washer are attached to the second end.

One of the rod ends can include a plurality of frangible sections, and each of such sections can be externally threaded; the sections can either be of equal or of unequal length.

Each of the grasping or clamping arms preferably comprises a highly conductive metal, e.g., steel, aluminum (either alone or alloyed), or zinc; and the arms can be slightly inwardly cambered to enhance the maximum gripping effect of the arms despite any upwardly directed flexing of the member or rod.

The clamp is used in combination with the fixture or a different support, wherein the clamp arms are attached to opposite sides of the fixture or support in order to establish adequate mechanical and electrical contact for the ground connection.

In a second aspect, the present invention provides an electrical grounding clamp adapted to be removably attached to a fixture or support. The clamp comprises: an elongated, generally cylindrical member, e.g., a rod, comprising an electrically-conductive metal, the rod having a first end and a second end; a first, generally L-shaped grasping arm which is attached to the first rod end, the first grasping arm having an internal recess with threads which are adapted to threadably engage corresponding threads on the exterior surface of the first end of the elongated member, the first grasping arm further comprising a serrated or roughened portion, or a portion with a plurality of diamond-shaped portions thereon, which is adapted to electrically and mechanically contact an exterior surface of the support; a second, generally L-shaped grasping arm which is attached to the second rod end, the second grasping arm having a through-bore which is adapted to slidably engage the second end of the elongated rod, the second grasping arm further comprising a serrated portion which is adapted to electrically and mechanically contact the exterior surface of the support; and means for adjustably spacing the first and second grasping arms from each other, along the elongated rod, the spacing means comprising, e.g., a nut threadably engaging a portion of the second end of the rod which extends outwardly from the second grasping arm, wherein the second rod end comprises a plurality of frangible threaded portions.

BRIEF DESCRIPTION OF THE DRAWINGS

The above and other objects, features, and advantages of the present invention are detailed hereinafter with respect to the accompanying drawings, in which like reference characters are used to describe similar parts throughout the several views, and wherein:

FIG. 5 is a front plan view of the elongated rod, without the grasping arms attached to the rod;

FIG. 6 is a front exploded view of the clamp formed according to the invention;

FIG. 7 is a cross-sectional view of a second embodiment of an elongated member used in the grounding clamp of the present invention; and FIG. 8 is a cross-sectional view of a third embodiment of an elongated member used in the grounding clamp of the present invention.

DETAILED DESCRIPTION OF THE DRAWINGS

Figure 1:
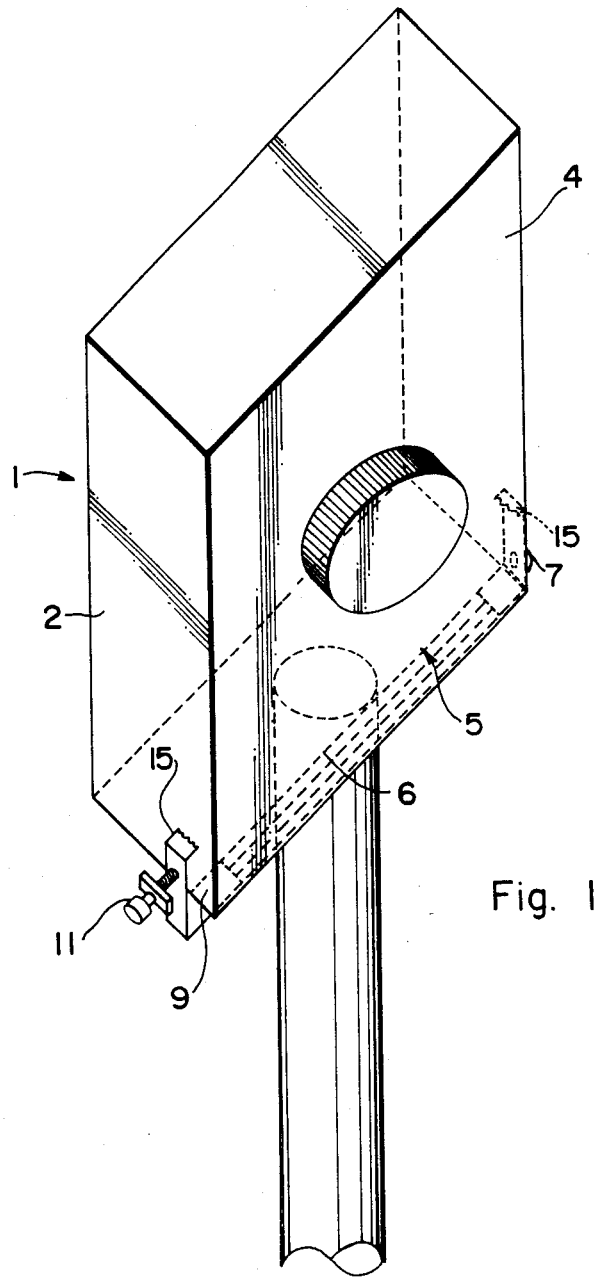
FIG. 1 is a perspective view showing the left side connection of a grounding clamp formed in accordance with the present invention, the grounding clamp being attached to an electrical meter box.

Referring first in more detail to FIG. 1, an electrical power meter box 1 is shown positioned on a cable riser mount 3, and attached along the underside and opposed first and second sides 2 and 4 of the power meter box 1 (having a meter 1*a*) is a grounding clamp 5 formed in accordance with the present invention. As seen best in the embodiment of FIGS. 3 and 5, the grounding clamp is formed from an elongated, rigid, solid and metal rod 6 having first and second ends to which first and second grasping arms 9 and 7 are attached, respectively. Rod or member 6 can be generally cylindrical, as shown in FIGS. 1–6; generally hexagonal, as in FIG. 7 or generally U-shaped, as in FIG. 8. Each grasping arm 7, 9, as best seen in FIGS. 3 and 5, is a generally L-shaped, slightly cambered, member having a serrated edge 15 with a plurality of spaced peaks that make both physical and electrical contact with the exterior metal surface of the power meter box, which is at an earth ground electrical potential. The L-shaped grasping arms are most preferably formed of an electrically conductive material, e.g., steel, aluminum, or zinc; and rod 6 is preferably formed of, e.g., aluminum or steel, as long as it is conductive and metallic.

As shown in FIGS. 1 and 6, first grasping arm 9, on the left-hand side of the clamp 5, includes a terminal 11 extending outwardly from arm 9. Terminal 11 includes a threaded portion 11*a* which is attached to a bore 21 in the grasping arm in a conventional fashion, e.g., by complementary threads; the terminal is adapted to receive and hold an external ground wire 8 which is fastened to the terminal by means of a known tightening mechanism, such as by a wing nut 13. While only arm 9 is shown with a bore, both arms could include such a bore to minimize the costs involved in molding or stamping the arms. The bores need not be used on both of the arms. Pressure contact that is caused by a tightening fixture, (e.g., nut 19) on the right side of elongated rod 6 causes a pressure fit of the grounding clamp 5 to the electrical power box 1 by creating pressure contact between serrated edges 15 (of both grasping arms 7 and 9) with opposed exterior surfaces of the metal box structure, i.e., of the fixture or support to which the clamp is adapted to be attached. In addition to mechanically holding the ground clamp in place, the serrations on the inner clamp edges also ensure solid electrical contact between the ground clamp and the support surface, due to the penetrating effect of the serrated edges, through most surface coatings, such as paint, and the construction of the grounding clamp from an electrically conductive metal. While surface 15 is shown as being serrated, it could also be, e.g., roughened or provided with a plurality of diamond-shaped, pointed sections; in other words, as long as the surface 15 is configured so that it can penetrate paint on the surface of the ground support, and thereby establish suitable electrical contact.

The serrations 15, as shown, comprise a plurality of fixture-engaging peaks (unreferenced) which are preferably spaced apart from each other by a uniform distance.

Threaded portion 11*a*, as shown in FIG. 6, can include a pointed tip which extends completely through bore 21 so that it can supplement the gripping action of surface 15.

Elongated rod 6, which is shown as being generally cylindrical, includes a first end 6*a* and a second end 6*b*, both of which are preferably threaded, and both of which can include one or more easily frangible sections to change the size of the rod (and, therefore, the length of the clamp).

FIG. 7 shows a rod (6') which is hexagonal with appropriate external threads to be engaged by bores 12 and/or 14; and FIG. 8 represents a third embodiment of the rod (6'') having an externally threaded, generally U-shaped configuration (which is normally made from extruded aluminum). The rods/members of FIGS. 7 and 8 have frangible ends, as does the rod of FIGS. 1–6.

Figure 2:
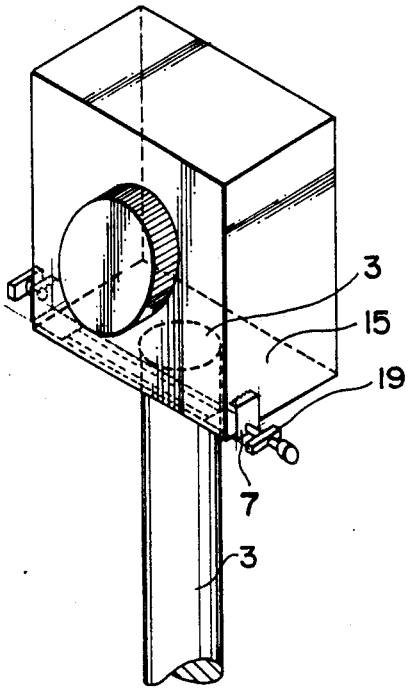
FIG. 2 is a perspective view showing the right-hand side of the grounding clamp as attached to the electrical meter box.
Figure 3:
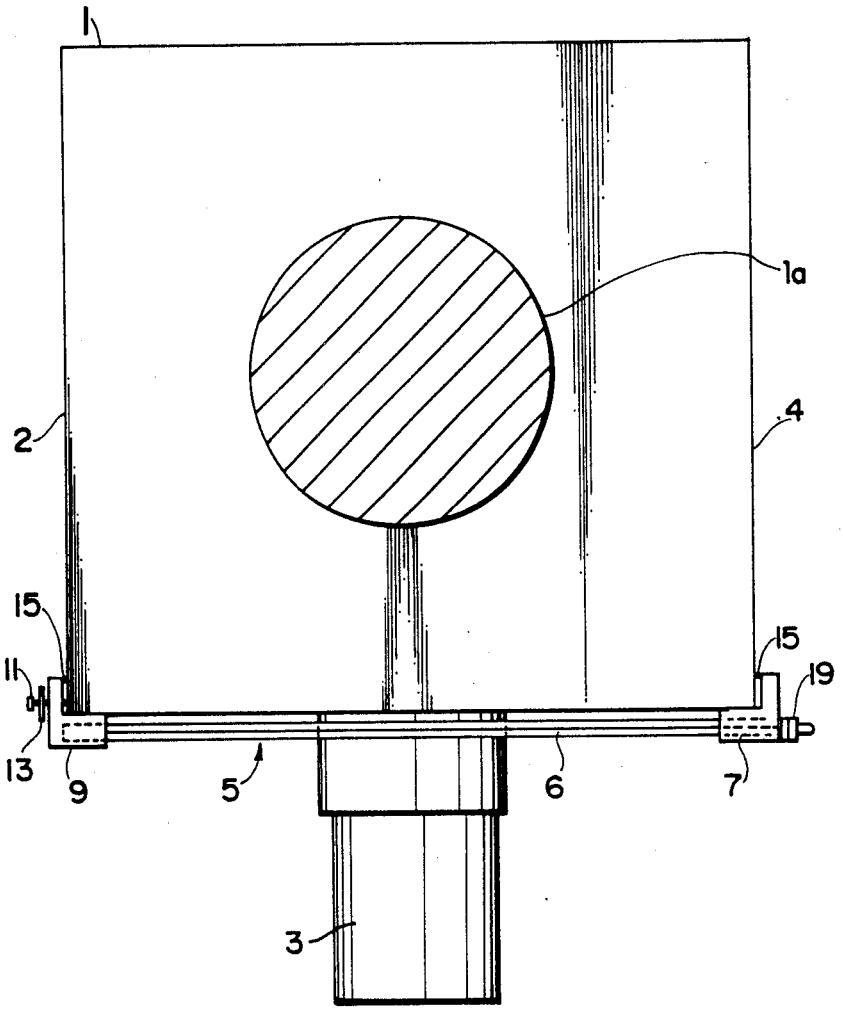
FIG. 3 is a front plan view showing the grounding clamp attached to the electrical meter box.

In FIG. 2, clamp 5 is shown viewed in perspective from the right-hand side so as to better depict the features of right grasping arm 7. Right (second) grasping arm 7 has the same type of (serrated, roughened, or provided with diamond-shaped portions, e.g.) inner edge 15 as does left (first) grasping arm 9, which edges come into physical and electrical contact with an outer side wall of the electric breaker box 1. Right grasping 7 arm is slidably positioned, via bore 14, over the right-hand (second) end 6*b* of elongated rod or member 6, and is capable of being moved inwardly towards the opposite (first) end (6*a*) of rod 6. Alternately, or additionally, the left hand arm 9 could be so positioned; in other words, either arm could be the first arm, and either (or both) could include a bore 21 for receiving terminal portion 11*a*. Tightening means are provided in the form of a nut 19 and a lock washer 16, with the nut being rotatable in a clockwise direction on standard machine threading of the rod end 6*b* so as to exert pressure on the right grasping arm 7 and thereby cause the arm to move inwardly and make contact with the electric meter box 1 as the tightening nut is advanced on the rod. The end of the rod is affixed with a protective cap 66. Nut 19 may be either a conventional machine nut, a wing nut for manual tightening, or any other similar type of hardware adapted for movement along the threaded rod to fasten the grounding clamp to an intervening structure, such as the metal meter box, and to tighten it through pressure applied so as to ensure a solid mechanical and electrical contact.

FIG. 3 is a front view of the ground clamp 5 as attached to opposed sides of the electrical power meter box 1. Serrations (or other grip enhancers) 15 are clearly shown as contacting sides 2 and 4 of box 1, since pressure has been applied to grasping arm 7 by nut 19.

The generally L-shaped arms are both cambered slightly, in order to compensate for any upward flexing of rod 6 which occurs as the clamp is tightened; by forming the arms 7 and 9 in this manner, effective grasping action is achieved despite any such rod flexure.

Figure 4:
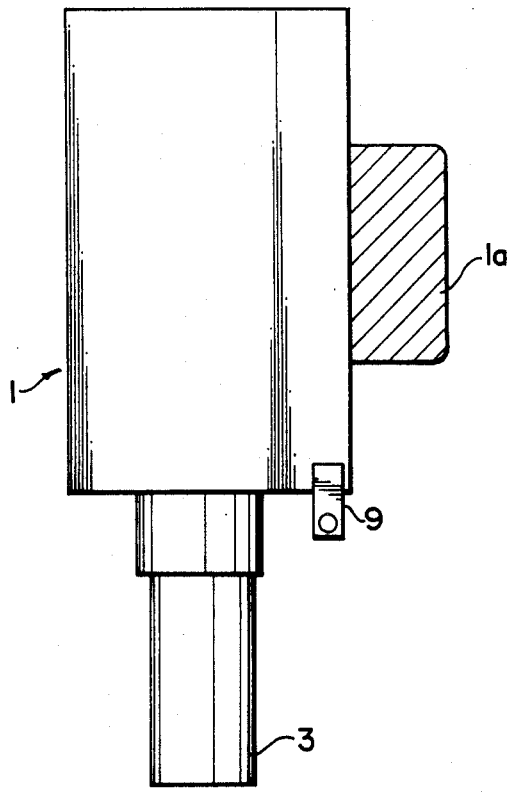
FIG. 4 is a left-hand side plan view of the grounding clamp of FIGS. 1–3.

FIG. 4 is a left-hand side view of the installation of FIG. 3, illustrating the ground clamp as being fastened to the underside, and towards the front, of an electrical power meter box 1. The ground clamp could equally well be attached to any part of the meter box 1 or other support, provided that the dimensions of the support permit the same. This can be beneficial where further space may be necessary for performance of required work.

FIG. 5 shows elongated rod 6 with a left threaded end portion 6*a* on its left side, and a threaded portion 6*b* on the right side, with three score lines 18, 20 and 22 marked thereon to provide manual breaking points so that the threaded segments formed by the score lines can be broken off and detached from the rod to adjust the length of rod 6 and to accommodate it to the size of the particular ground fixture or support to which it is to be attached. Similar frangible sections can be provided on the left-hand rod side; the sections can be of either uniform or unequal lengths, and a greater number of sections can be provided if desired. Frangible and/or threaded end sections (at either or both rod ends) can similarly be provided in rods 6' and 6''.

FIG. 6 illustrates the rod with the generally L-shaped grasping arms 7 and 9 attached to opposed ends thereof. The left (first) grasping arm 9 is shown with its serrated edge 15, and has a ground terminal 11 extending outwardly on the side of the arm opposite from the serrated edge; the terminal is provided for attachment of an electrical ground wire 8. The left-hand end 6*a* of rod 6 is fitted into an internally threaded, recessed cavity 12 of left grasping arm 9 by complementary standard machine threads on the inside periphery of the recessed cavity 12 that match with threads on the threaded end portion of the left end of rod 6. Cavity 12 is a closed recess which does not extend through the entire length of L-shaped member 9. Right grasping arm 7, which is substantially L-shaped, contains a through-bore 14 in its lower portion which extends through right grasping arm 7. Although not shown, bore 14 could be threaded, and/or the arms 7 and 9 could be identically formed by molding or stamping, such that both include identical cores 14 and 21; alternately the arms could be formed identically, with the exception of bores 12 and 14 being different. The right-hand end 6*b* of rod 6 projects outwardly beyond the right grasping arm 7 with a lock washer 16 placed over the right threaded end portion of rod 6, and a standard nut 19 is screwed onto the right threaded end 6*b* of rod 6, and is rotatable about the axis of rod 6 so as to move itself and lock washer 16 inwardly to cause the spacing between the right and left grasping arms 7 and 9, respectively, to be reduced until firm contact is made with an intervening structure that is at an earth ground electrical potential, such as the electrical meter box 1 which is illustrated.

Referring now to FIG. 6, each of the generally L-shaped grasping arms has a long leg 32, a short leg 34, and a short projection 36. The serrations 15 are provided at the end of leg 36. Arm 9 includes a ground terminal recess 21 in leg 32, into which the standard ground terminal assembly 11 is threadably and securely mounted in a conventional manner so as to extend outwardly from planar surface 32. Right grasping arm 7 is similar to arm 9, with the main difference as shown being that right grasping arm 7 includes the cylindrical through-bore 14 that runs throughout the length of the leg 34, through which extends the right threaded end portion of rod 6. Cylindrical opening 14, preferably, has no threaded grooves on its interior surface, as does recessed cavity 12 in the left grasping arm 9; but is sized so as to slidably engage the second rod end. Other features of right grasping arm 7 are substantially the same as those of left grasping arm 9, but without any protruding terminal, such as the ground terminal 11 that is attached to left grasping arm 9. If desired, in order to facilitate manufacture, all of the bores could be internally threaded (although, as noted previously, the two arms could be formed as mirror images of each other).

Circular through-bore 14, which extends through the leg 34 of right grasping arm 7, as shown in FIG. 6, allows for tightening means 19 to be rotated to narrow the spacing between the left and right-hand grasping arms, and to eventually cause serrated edges 15 to come into contact with the intervening metal structure, e.g., support/box 1, that is at earth ground potential. Further tightening of the spacing means ensures a solid mechanical and electrical contact between the grounding clamp and the structure to which it is attached, and that any point will be pierced where surface 15, and the tip of portion 11*a*, engage the support. Attachment of an external wire to ground terminal 11, which is mounted outwardly as a part of left grasping arm 9, provides a readily accessible point for making a ground connection by hooking an external ground wire 8 to ground terminal 11 and running it to electrical equipment, or other points at remote locations, as needed.

The grounding clamp is easily installed manually, especially if wing nuts 13 and 19 are used for manual tightening at the ground terminal 11 and at the end 6*b* of rod 6, respectively. The clamp can likewise be easily removed from the structure when the work is finished and the grounding connection is no longer needed, and its design results in a solid electrical earth ground connection.

Further, if it is necessary to change the length of bar 6 to establish a proper electrical connection, one or more frangible, threaded sections can be easily detached from end 6*b* of bar 6 (or of the members 6′ and 6″ shown in FIGS. 7 and 8).

From the foregoing description, one skilled in the art can easily ascertain the essential characteristics of this invention and, without departing from the spirit and scope thereof, can make various changes and modifications of the invention to adapt it to various usages and conditions.

I claim:

1. An electrical grounding clamp adapted to be removably attached to a fixture, said clamp comprising:
   (a) an elongated member comprising an electrically-conductive metal, said elongated member having a first end and a second end;
   (b) a first grasping arm and a second grasping arm, each of said arms comprising means for gripping an exterior surface of said fixture, wherein each of said grasping arms is substantially L-shaped said gripping means on each of said arms comprising means for establishing physical and mechanical contact with said exterior surface of said fixture when said clamp is attached to said fixture;
   (c) means for attaching an external grounding wire to at least one of said grasping arms;
   (d) means for attaching said first grasping arm to said first end of said elongated member;
   (e) means for mounting said second grasping arm on said second end of said elongated member; and
   (f) spacing adjustment means, located at one of said ends of said elongated member, for varying the spacing between said first grasping arm and said second grasping arm when said grasping arms are positioned on said first and second member ends.

2. A clamp in accordance with claim 1, wherein said member is a cylindrical rod having a substantially uniform outer diameter.

3. A clamp in accordance with claim 1, wherein said member comprises an elongated rod having a hexagonal cross-section.

4. A clamp in accordance with claim 1, wherein said member comprises an elongated rod having a substantially U-shaped cross-section.

5. A clamp in accordance with claim 1, wherein said gripping means comprise a roughened surface on each said arm.

6. A clamp in accordance with claim 1, wherein said gripping means comprises a plurality of diamond-shaped members on each said arm.

7. A clamp in accordance with claim 1, wherein said gripping means comprises a serrated surface on each of said arms.

8. A clamp in accordance with claim 1, wherein each of said arms is slightly cambered such that, when said arms are positioned on said elongated member and said clamp is attached to said fixture, said arms are inclined, in a gripping relationship, towards said fixture.

9. A clamp in accordance with claim 1, wherein said first grasping arm and said second grasping arm are adapted to be placed into contact with opposite sides of a ground fixture by said spacing adjustment means, said spacing adjustment means thereby comprising means for selectively reducing the spacing between said first grasping arm and said second grasping arm.

10. A clamp in accordance with claim 1, wherein said first grasping arm comprises an interior cavity of a predetermined length, said cavity having a threaded interior surface adapted to threadably engage said first member end, wherein said first member end is also threaded.

11. A clamp in accordance with claim 1, wherein one of said member ends includes a plurality of frangible sections.

12. A clamp in accordance with claim 1, wherein each of said arms comprises an electrically conductive material.

13. A mechanical clamp in accordance with claim 1 in combination with said fixture, wherein said grasping arms are attached to opposite sides of said fixture.

14. A clamp in accordance with claim 1, wherein at least said first member end is threaded over a predetermined distance.

15. A clamp in accordance with claim 14, wherein both of said ends are threaded over a predetermined distance.

16. A clamp in accordance with claim 1, wherein said spacing adjustment means are rotatably positioned about one of said member ends.

17. A clamp in accordance with claim 16, wherein at least said second member end is threaded, said spacing adjustment means comprising a nut having machine threads which are adapted to engage said threaded second member end.

18. A clamp in accordance with claim 17, wherein said nut is rotatable along said member from said second member end toward said first member end, said nut thereby comprising means for effecting pressure against said second grasping arm and for moving said second grasping arm towards said first member end so as to reduce the spacing between said first grasping arm and said second grasping arm.

19. A clamp in accordance with claim 1, wherein each of said gripping means comprises a saw-toothed shaped surface area comprising a plurality of fixture-engaging peaks.

20. A clamp in accordance with claim 19, wherein said peaks are spaced apart by a predetermined, uniform distance from each other.

21. A clamp in accordance with claim 1, wherein said second grasping arm comprises a cylindrical through-bore extending longitudinally through said second grasping arm, said through-bore comprising means for slidably receiving a second end of said member.

22. A clamp in accordance with claim 21, wherein said second end of said member is positioned within said through-bore and extends beyond said second grasping arm, said clamp further comprising a nut with a lock washer which is attached to said second member end.

23. A clamp in accordance with claim 1, said attaching means comprising an elongated, externally threaded portion which is threadably connected to an internally threaded bore in one of said arms.

24. A clamp in accordance with claim 23, wherein said threaded portion has a pointed tip which extends through said arm bore and comprises part of a gripping surface on said gripping means.

25. A mechanical grounding clamp adapted to be removably attached to a support, said clamp comprising:

(a) an elongated member comprising an electrically-conductive metal and having a threaded first end and a threaded second end;

(b) a first, generally L-shaped grasping arm which is attached to said first member end, said first grasping arm having an internal recess with threads which are adapted to threadably engage corresponding threads on the first end of said elongated member, said first grasping arm further comprising a gripping surface which is adapted to electrically and mechanically contact an exterior surface of said support;

(c) a second, generally L-shaped grasping arm which is attached to said second member end, said second grasping arm having a through-bore which is adapted to slidably engage the second end of said elongated member, said second grasping arm further comprising a gripping surface which is adapted to electrically and mechanically contact said exterior surface of said support; and (d) means for adjustably spacing said first and second grasping arms from each other, said spacing means comprising a nut threadably engaging a portion of said second end of said member which extends outwardly from said second grasping arm.

26. An electrical grounding clamp adapted to be removably attached to a fixture, said clamp comprising:

(a) an elongated member comprising an electrically-conductive metal, said elongated member being an elongated rod having a substantially U-shaped cross-section and having a first end and a second end;

(b) a first grasping arm and a second grasping arm, each of said arms comprising means for gripping an exterior surface of said fixture;

(c) means for attaching an external grounding wire to at least one of said grasping arms;

(d) means for attaching said first grasping arm to said first end of said elongated member;

(e) means for mounting said second grasping arm on said second end of said elongated member; and (f) spacing adjustment means, located at one of said ends of said elongated member, for varying the spacing between said first grasping arm and said second grasping arm when said grasping arms are positioned on said first and second member ends.

27. An electrical grounding clamp adapted to be removably attached to a fixture, said clamp comprising:

(a) an elongated member comprising an electrically-conductive metal, said elongated member having a first end and a second end, wherein both said first and second ends are threaded over a predetermined distance;

(b) a first grasping arm and a second grasping arm, each of said arms comprising means for gripping an exterior surface of said fixture;

(c) means for attaching an external grounding wire to at least one of said grasping arms;

(d) means for attaching said first grasping arm to said first end of said elongated member;

(e) means for mounting said second grasping arm on said second end of said elongated member; and (f) spacing adjustment means, located at one of said ends of said elongated member, for varying the spacing between said first grasping arm and said second grasping arm when said grasping arms are positioned on said first and second member ends.

28. A clamp in accordance with claim 27, wherein each of said grasping arms is substantially L-shaped, said gripping means on each of said arms comprising means for establishing physical and mechanical contact with said exterior surface of said fixture when said clamp is attached to said fixture.

29. An electrical grounding clamp adapted to be removably attached to a fixture, said clamp comprising:

(a) an elongated member comprising an electrically-conductive metal, said elongated member having a first end and a second end;

(b) a first grasping arm and a second grasping arm, each of said arms comprising means for gripping an exterior surface of said fixture, wherein said first grasping arm comprises an interior cavity of a predetermined length, said cavity having a threaded interior surface adapted to threadably engage said first member end, wherein said first member end is also threaded;

(c) means for attaching an external grounding wire to at least one of said grasping arms;

(d) means for attaching said first grasping arm to said first end of said elongated member;

(e) means for mounting said second grasping arm on said second end of said elongated member; and (f) spacing adjustment means, located at one of said ends of said elongated member, for varying the spacing between said first grasping arm and said second grasping arm when said grasping arms are positioned on said first and second member ends.

30. An electrical grounding clamp adapted to be removably attached to a fixture, said clamp comprising:

(a) an elongated member comprising an electrically-conductive metal, said elongated member having a first end and a second end, wherein one of said member ends includes a plurality of frangible sections;

(b) a first grasping arm and a second grasping arm, each of said arms comprising means for gripping an exterior surface of said fixture;

(c) means for attaching an external grounding wire to at least one of said grasping arms;

(d) means for attaching said first grasping arm to said first end of said elongated member;

(e) means for mounting said second grasping arm on said second end of said elongated member; and (f) spacing adjustment means, located at one of said ends of said elongated member, for varying the spacing between said first grasping arm and said second grasping arm when said grasping arms are positioned on said first and second member ends.

31. A clamp in accordance with claim 30, wherein each of said frangible sections is threaded.

32. A clamp in accordance with claim 31, wherein said frangible sections are of substantially equal length.

* * * * *